US006530847B1

(12) United States Patent
Antonious

(10) Patent No.: US 6,530,847 B1
(45) **Date of Patent: *Mar. 11, 2003**

(54) METALWOOD TYPE GOLF CLUB HEAD HAVING EXPANDED ADDITIONS TO THE BALL STRIKING CLUB FACE

(76) Inventor: Anthony J. Antonious, 7738 Calle Facil, Sarasota, FL (US) 34238

( * ) Notice: Subject to any disclaimer, the term of this patent is extended or adjusted under 35 U.S.C. 154(b) by 0 days.

This patent is subject to a terminal disclaimer.

(21) Appl. No.: 09/641,705

(22) Filed: Aug. 21, 2000

(51) Int. Cl.[7] ..... A63B 53/04
(52) U.S. Cl. ..... 473/327; 473/345; 473/349
(58) Field of Search ..... 473/256, 324, 473/327, 328, 345, 346, 349, 350, 334, 335; D21/733, 752, 753, 735

(56) References Cited

U.S. PATENT DOCUMENTS 723,534 A * 3/1903 Knight
3,595,577 A * 7/1971 Hodge
D229,431 S * 11/1973 Baker
4,065,133 A * 12/1977 Gordos
4,432,549 A * 2/1984 Zebelean
5,078,400 A * 1/1992 Debiolles
5,203,565 A * 4/1993 Murray
5,482,279 A * 1/1996 Antonious
D390,616 S * 2/1998 Maltby
5,766,095 A * 6/1998 Antonious
D399,289 S * 10/1998 Sheets
5,954,595 A * 9/1999 Antonious
5,989,134 A * 11/1999 Antonious
6,123,627 A * 9/2000 Antonious

FOREIGN PATENT DOCUMENTS

AU 211781 * 12/1957 ..... 273/167 F

* cited by examiner

*Primary Examiner*—Sebastiano Passaniti
(74) *Attorney, Agent, or Firm*—Welsh & Flaxman LLC

(57) ABSTRACT

A metalwood type golf club head including a club head body having a toe, heel, top surface, bottom sole, side surfaces, rear surface and ball striking face having at least one raised, elongated, aerodynamically shaped reinforcing and stabilizing member extending outwardly from a side or bottom surface, and having a front face coincident with the ball striking face. The structure provides improved weight distribution for better balance, additional strength and stability to club head and provides more effective aerodynamic surfaces to increase club head speed.

5 Claims, 10 Drawing Sheets

METALWOOD TYPE GOLF CLUB HEAD HAVING EXPANDED ADDITIONS TO THE BALL STRIKING CLUB FACE

BACKGROUND OF THE INVENTION

The present invention relates to the golf club heads shown and described in my prior U.S. Pat. No. 5,954,595, which is incorporated herein by reference, and in particular, to an improved metalwood type golf club head, having additional expanded ball contact area at the extreme toe and heel sections on the club face, including disproportionately downsized crown and sole sections.

Most wood-type club heads are currently made of metal, either totally of steel, titanium, or combined with other alloys. Other club heads include a shell made of a steel with a face insert that is made of titanium or similar lighter weight material. This permits club heads to be much larger, yet meet the accepted weight parameters for the respective drivers and fairway type metalwoods.

Although these club heads are substantially enlarged overall, with higher face heights and wider, bulkier crowns and sole bottoms, their club faces have not increased the effective ball contact hitting area, in a heel to toe direction, proportionately to the overall enlarged club heads for possible improved performance, for most golfers. To keep the overall club head size larger, and lighter, as currently demanded by most higher handicap golfers, the structural integrity of the side walls and the club faces, is often compromised. This causes stress cracks, unstable club head control at ball contact, and erratic ball flight control, resulting in loss of distance, accuracy, and inability to produce reassuring and repeating solid ball contacts, even when hit flush.

Many attempts have been made to reinforce metal wood type club heads as shown and described in the prior art. Raymont (U.S. Pat. No. 3,847,399) reinforces the back of the club face with a honeycomb structure. My own U.S. Pat. No. 5,141,230 reinforces the interior of a metalwood with a first mass located behind the ball striking face, and my U.S. Pat. No. 5,482,279 provides an interior peripheral mass basically along the inner periphery, of the club head shell behind the club face. U. S. Pat. No. 5,931,745 to Adams shows a low profile, wood type golf club head wherein the bottom sole surface is larger than the upper crown surface.

Various structural improvements have been used to strengthen and modify the integrity of prior art conventional metalwoods. Nevertheless, for most golfers, the subtle changes to the club head and the expected performance of the larger metalwood club heads, have been disappointing. The performance of most of these metalwoods has not materially improved club head feel at ball contact, or significantly increased club head stability and control for anticipated improved accuracy and additional significant distance. Consequently, they have not meaningfully advanced the golfers' performance potential.

SUMMARY OF THE INVENTION

The important effect of the aerodynamic behavioral characteristics especially for the larger metalwood club heads, is always a most critical aspect, in its overall design. The quest to create a substantive improvement in a metalwood club head, that exceeds the performances of all competitive leading brands, will always present a challenge for anyone involved in the design and development of metalwood club heads. The new concept of this invention accomplishes this objective, in a novel, practical and worthy manner by producing different results in a different manner. The extraordinary high-tech performance accomplishments of the present invention represent improvements in golf club technology which began over twenty years ago by the present inventor.

The improved concept of the present invention for metalwood type golf club heads, provides considerable additional laterally expanded ball contact areas, particularly at the toe and heel sections of the club face without proportionately enlarging the top or crown sections and the bottom or sole sections, of the club heads. Consequently, this improvement utilizes a smaller crown area and sole area than most of the larger club heads in the range of 230–300 cc and larger, to effectively redistribute the weight to the expanded areas, at the toe and heel ends of the club face of the present invention. This improved structural design increases the ball contact hitting area dramatically, by as much as 33%. By laterally expanding the hitting areas and increasing the weight at the extreme toe and heel sections, a much larger and more forgiving "sweet spot" is provided on the club face. This creates a low-profile, high-performance golf club head, supremely adaptable for both the driver-type or fairway-type metalwood club heads.

The driver-type metalwood club heads, generally have larger club faces than their counterpart fairway woods. Since the faces of the driver metalwoods are "wider and higher" with lesser lofts, which can be in the range of 7° to 11°, golf balls are usually "teed up", at address. This facilitates making "solid ball" contact, within or adjacent to the more rewarding centrally located "sweet spot" on the larger club face of drivers, which can have heights in the approximate ranges of 1.625" to 2.000". However, the "wider and higher" club faces that create the "low profile" concept of the present invention, permits also having "higher lofts", in addition to "wider and higher" club faces, for all sizes of fairway metalwood club heads. The higher club face lofts for these fairway woods are in the range of 13° to 28°. The unusual club face heights for fairway club heads of this invention are in the approximate range of 1.500" to 1.625".

Having fairway metalwoods with larger, more formidable-sized club faces, golfers are not intimidated by the size of the standard golf ball. The available ball contact areas of the smaller more "shallow faces" of the conventional fairway woods can be, and often are, intimidating by the much larger size of the golf ball, when aligning it with the "smaller faced" fairway clubs, at address. Unlike the smaller more "shallow faces" of the conventional fairway metalwoods, the much larger hitting area on the fairway metalwood club faces of the present invention, increases a golfer's confidence and enhances his ability to make more solid and effective ball contact, consistently.

Further, the concept of the present invention, made on a specific embodiment, permits and expanded hitting surface, located at the extreme lower portion of the club face. This unique formation on the club face, includes a reinforcing and supporting member that is located on the bottom of the club head and extends rearwardly from its own hitting surface, which is coincident with the club face. The extraordinary overall construction of the present invention, not only minimizes or eliminates undesirable shocks and vibrations, but produces the most formidable club head stability, when the most severe off-center ball contacts occur, even when made at the extreme toe, heel or lowest portion of the club face. The outermost extending surfaces of the laterally expanded areas to the club face, are generally curved, forming parabolic, rounded, or elliptical type end shapes.

Significantly, the golf club heads of the present invention also provide aerodynamically shaped reinforcing and stabilizing members that extend rearwardly from the expanded ball contact areas and are located at the rear and side walls of the club head body, forming the outermost perimeter of the club head and extend in an outward direction beyond the crown and sole surfaces of the club head. This improvement provides improved precise weight distribution, surrounding the club head, without proportionately enlarging the crown and sole sections of the club head. The expanded areas are located laterally, adjacent the heel and toe portions coincident with the ball striking face, thereby providing a larger, lateral ball contact area on the club face. The expanded areas to the club face, extend beyond a vertical plane defined by the boundaries of the top crown surface and bottom sole of the main club head body, as shown in the application drawings.

The reinforcing and stabilizing (R/S) members are the lynch-pin of the present invention. They directly contribute and enhance the optimum performance possible from each of the dominant features of the club head. They provide the formidable bracing support extending rearwardly from the expansions at the toe and heel sections of the club face to the side walls, and rear of the club head. They form the surrounding outer perimeter and are aerodynamically sculptured to produce substantially greater high-velocity club head acceleration that also provide greater "lift" to the club head . . . when executing the faster full swings with the longer shafted metalwood club heads. The additional "lift" of the reinforcing and stabilizing members noticeably permit a golfer, when swinging a club head weighing 203 grams, to "feel" like it weights 193 grams. The reinforcing and stabilizing members functions are comparable to the wings attached to the fuselage of an airplane. Similarly, the advanced aerodynamically-designed versatility and structurally sound and practical concept of the reinforcing and stabilizing members, dramatically produce unparalleled performance with the most impressive overall improvements, that are far greater than any prior art, for metalwood club heads.

Further, the improved present invention offers a more formidable and unmatched structural, overall, club head design for metalwoods. With this invention, golfers increase their confidence in their golf swing, permitting them to steadily improve their ability to repeatedly execute solid ball contact with greater accuracy and surprisingly greater distance.

The reinforcing and stabilizing member may include thicker walls to provide more mass at the extreme peripheral sections of the club face. This unique structure produces much greater overall club head control, strength, and stability, at ball-impact. This structure will minimize or practically eliminate any torqueing and twisting, especially for off-center hits when metalwood club heads, of this invention, are swung at the higher-velocity club head swing-speeds.

The present invention for metalwoods does not enlarge the ball contact area on the club face, proportionately to the size of the top or crown sections, or sole or bottom sections, of the club head, which is done for the prior art medium to large size metalwoods, generally in the range of 230–300 cc or larger. In fact, the ends or boundaries of the crown and sole sections, as designed, for such larger conventional club heads, lie within the vertical plane alignment clearly defined for these larger prior art club heads. By contrast, the additional expanded sections of the present invention, only laterally enlarge the ball contact areas, particularly at the outermost ends of the toe and heel sections, substantially beyond that of conventional metalwood club faces, and are located horizontally beyond or outside the established vertical plane alignment of other prior art metalwoods.

The expanded additions of the present invention, that create the larger expanded ball contact areas to the club face, are located and extend in a horizontal relationship, beyond the traditional toe and heel sections of the ball contact areas of the larger conventional metalwood type club face. The additional formation of the reinforcing and stabilizing weight members, extend and continue rearwardly (face to rear) from the expanded sections, to the club face, that also produce the outermost perimeter of the club head. This concept not only permits an extraordinary overall improved club head structural improvement, but also provides formidable reinforcing and stabilizing capabilities, specifically to the additional expanded sections to the club face, and to the rear and side walls of the club head.

The reinforcing and stabilizing members are formed below the interface of the crown and club face, and extend horizontally beyond the ends of the upper crown or sole portions of the club head.

Comparison of Dimensions For Metalwood Club Heads

| Description of Dimensions | Prior Art Ping 330 cc Model | Prior Art TaylorMade Driver Model | Present Invention |
|---|---|---|---|
| Actual Dimensions: (From Sample Club Heads) | (As shown in FIG. 23) | | (As shown in FIGS. 16, 17, 18 and 20) |
| Across Top/Crown: (At Center/Toe to Heel) | | | |
| a) Width of Crown | 4.625" | 4.500" | 2.500"–3.500 |
| b) Width from outer perimeter of opposing side walls of club head | 4.625" | 4.500" | 3.500" |
| c) Width from outer surfaces of opposing reinforcing and stabilizing members forming outermost perimeter beyond side walls located at rear, toe, and head sections of club head | Does not have this innovation | Does not have this innovation | 4.500" |
| Face: Length/Front to rear | 3.750" | 3.250" | 3.000" |
| Face: Height/ Between sole and crown | 2.000" | 1.750" | 1.625"–1.750" |
| Face: At widest point (Laterally from toe to heel) | 4.000" | 3.500" | 4.500" |
| Club Head Weight Range (in grams) | 200–205 | 200–203 | 198–202 |
| Club Head CC | 330 cc | 300 cc | 270–280 cc |
| All titanium Club Head | Yes | Yes | Yes |

In a preferred embodiment, reinforcing and stabilizing supporting segments to the expanded areas to the club face, are located along the lower portion of the club head, whereby the bottom or lower surfaces of the rearwardly extending reinforcing and stabilizing members, may be coincident with the bottom or sole surface of the club head. In other embodiments, the expanded areas to the club face and rearwardly extending reinforcing and stabilizing member may be located in between and/or adjacent the crown and sole surfaces of the club head.

Still other embodiments include a shelf or a set back area at the interface of the crown and ball striking face in combination with the expanded areas at the sides of the club head body.

Among the objects of the present invention is the provision of metalwood type golf club heads that enhance the potential for greater improved performance, for all caliber of golfers.

Another object of the present invention is the provision of metalwood type golf club heads, particularly for medium to large size metalwood club heads, in the range of 230–300 cc and larger, providing additional expanded sections to the club face that extend horizontally and considerably beyond the traditional ends of club faces for additional ball contact areas to the ends of the club face.

Another object is the provision of metalwood type golf club heads having reinforcing and stabilizing weight members extending from and beyond the sidewalls, rearwardly, face to rear, from the additional expanded sections to the club face, that further create an outermost perimeter to the club head.

Another object of the present invention is the provision that considerably expands the club face at the toe and heel section to greatly enlarge the ball contact area, by as much as 33% or more without proportionally enlarging the crown and bottom sections of the club head.

Another object of the present invention is the provision that immensely increases the "sweet spot" area on metalwood-type club heads, which substantially enhances ball feel at contact for improved club head control and stability, minimizing errant direction and distance loss.

These and other objects of the present invention will be understood from the drawings and the description that follows or may be learned from the practice of the invention.

DESCRIPTION OF THE PREFERRED EMBODIMENTS

Figure 1:
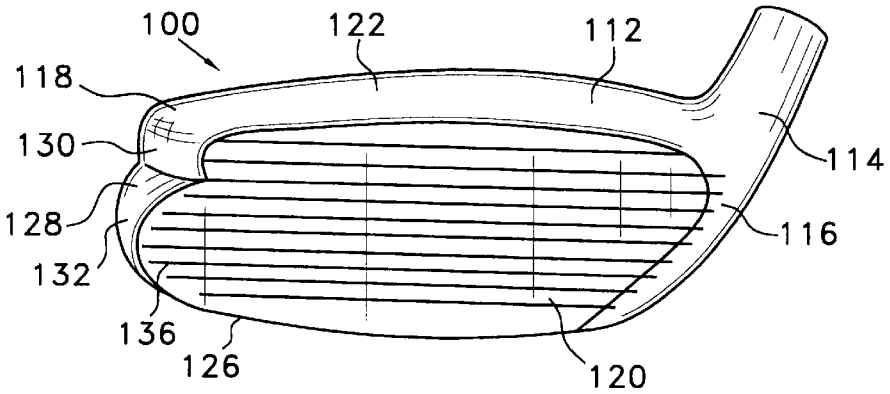
FIG. 1 is a front elevational view of a golf club head in accordance with the present invention.
Figure 2:
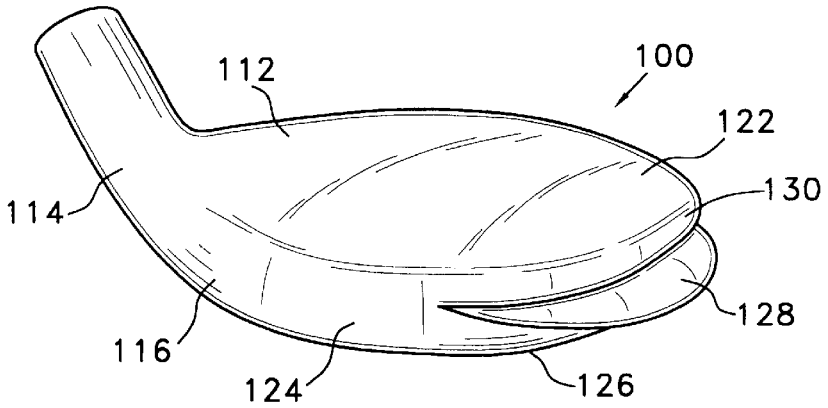
FIG. 2 is a rear elevational view of FIG.7.
Figure 3:
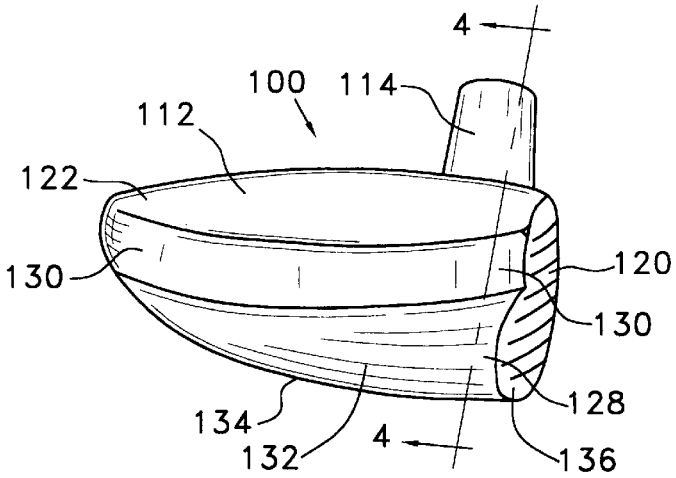
FIG. 3 is an end elevational view of FIG. 1.

The detailed embodiments of the present invention are disclosed herein. It should be understood, however, that the disclosed embodiments are merely exemplary of the invention, which may be embodied in various forms. Therefore, the details disclosed herein are not to be interpreted as limited, but merely as the basis for the claims and as a basis for teaching one skilled in the art how to make and/or use the invention.

FIGS. 1–4 show a first embodiment of a golf club head 100 in accordance with the present invention including a club head body 112, hosel 114, heel 116, toe 118, ball striking face 120, upper surface 122, rear surface 124 and bottom sole 126. A single reinforcing and stabilizing member 128 having an aerodynamic shape, is located coincident with or adjacent to the bottom surface 126 of the club head 100 and which wraps partially around the peripheral sides 130 of the club head 100. The member 128 includes upwardly curving, convex parabolic surface 132 including a lower surface 134 extending upwardly and coincident with the bottom sole 126 of the club head 100. In this embodiment, the member 128 has a front surface 136 which is laterally coincident with the ball striking face 120, thereby enlarging the ball contact surface of 120 and providing a greater margin for error when golf balls are struck away from the center of the ball striking face 120 toward the toe 118 of the club head 100.

Figure 4:
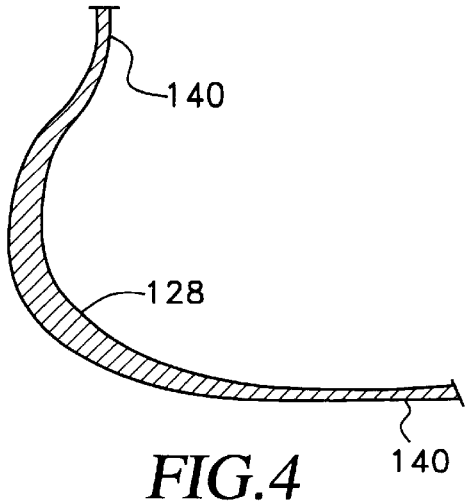
FIG. 4 is a partial sectional view taken along lines 4—4 of FIG. 3.

FIG. 4 is a partial sectional view of the reinforcing and stabilizing member 128 and metal shell 140 of the club head 100. The peripheral weight of the club head body 112 may be controlled by varying the thickness of this area. The thickness of the metal shell 140 is preferably in the range of 0.035–0.060 in. or greater, whereas the thickness of the expanded reinforcing and stabilizing member 128 may be in the range of 0.055–0.100 in. or greater.

Figure 5:
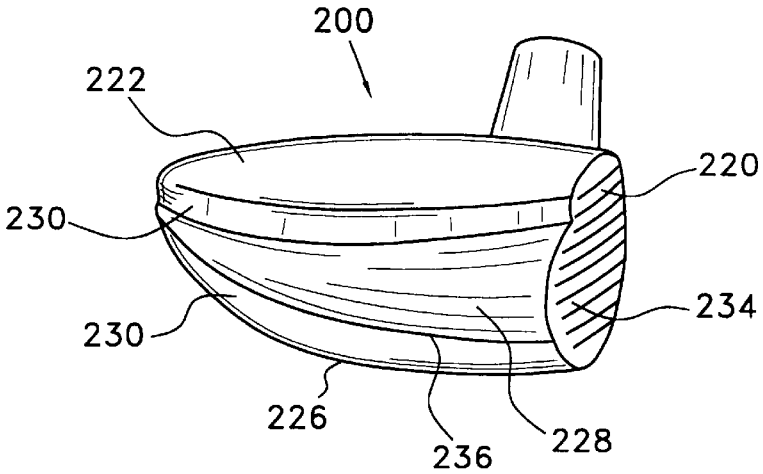
FIG. 5 is an end elevational view of a second embodiment of the present invention.

FIG. 5 illustrates a second embodiment of a golf club head 200 of the present invention. In this embodiment a reinforcing and stabilizing member 228 with a non-coincident bottom surface 236 is centrally located on the side wall 230 of the club head 200 approximately midway between the crown surface 222 and the bottom 226 of the club head 200.

Figure 6:
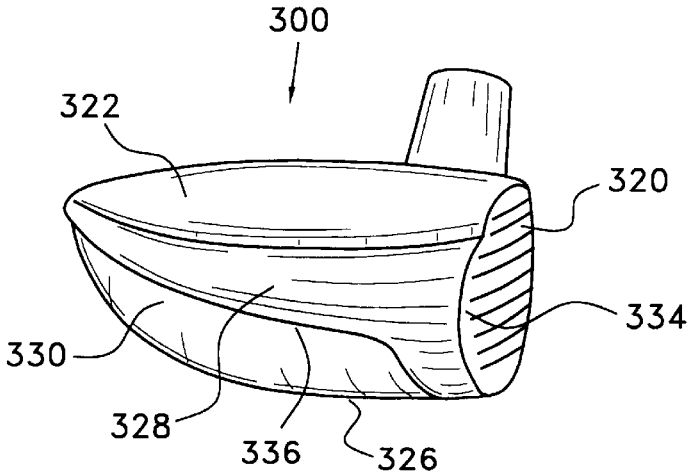
FIG. 6 is an end elevational view of a third embodiment of the present invention.
Figure 7:
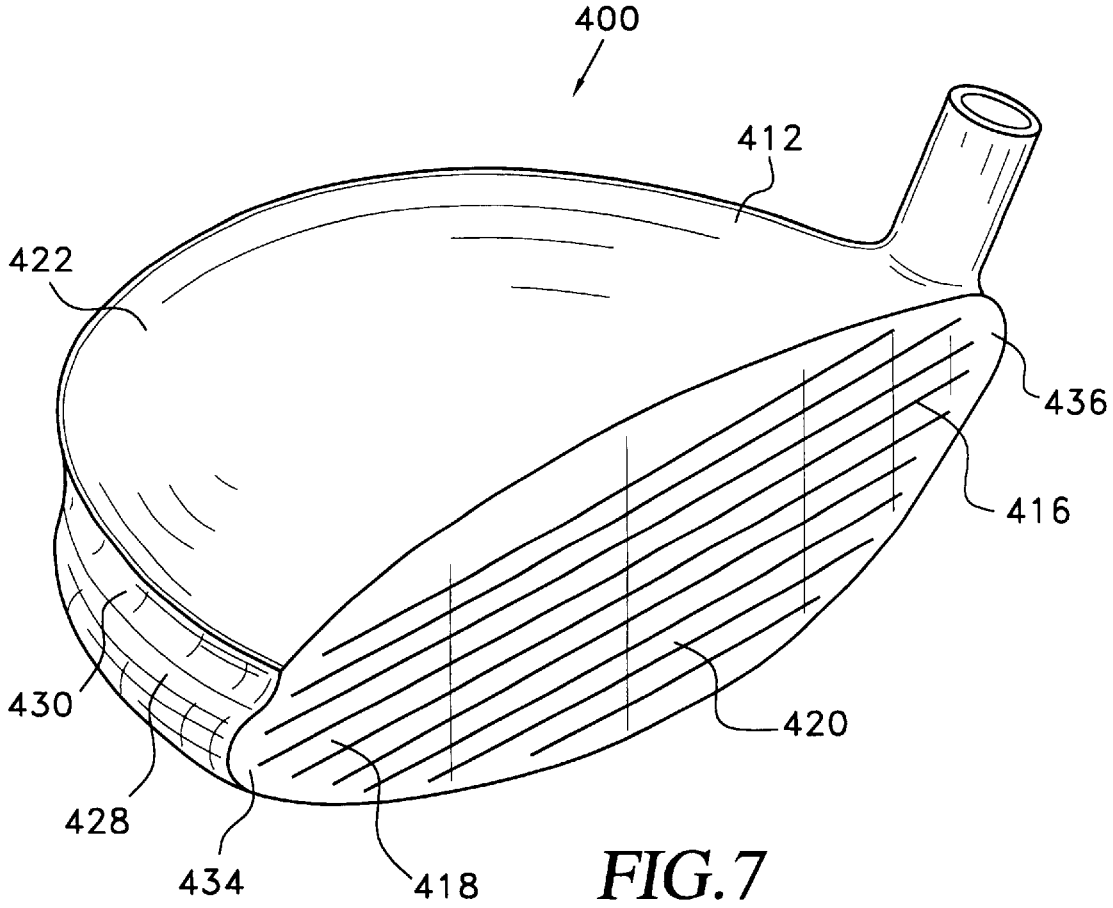
FIG. 7 is a top perspective view of a fourth embodiment of the present invention.
Figure 8:
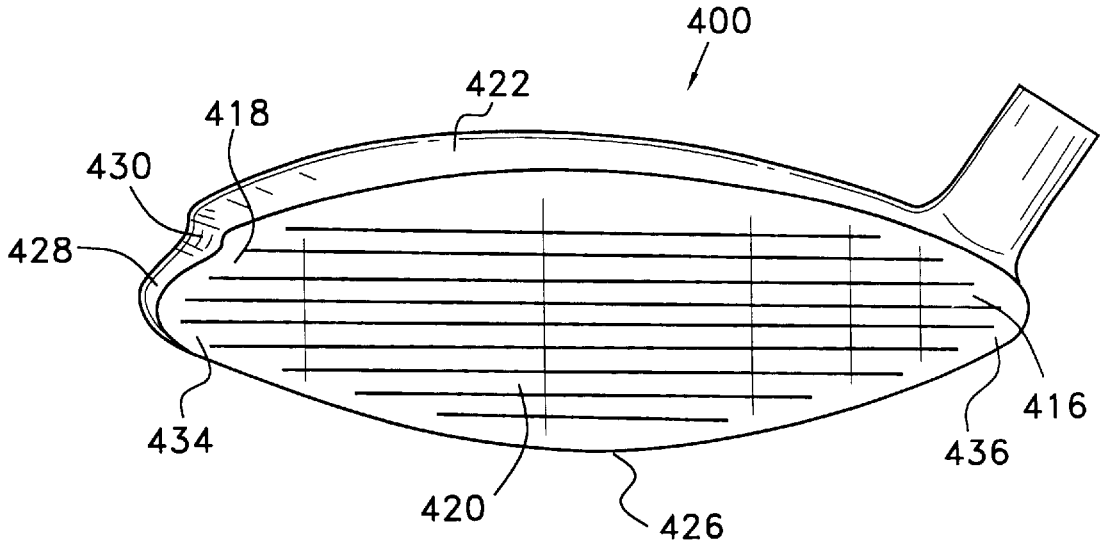
FIG. 8 is a front elevational view of FIG. 7.
Figure 9:
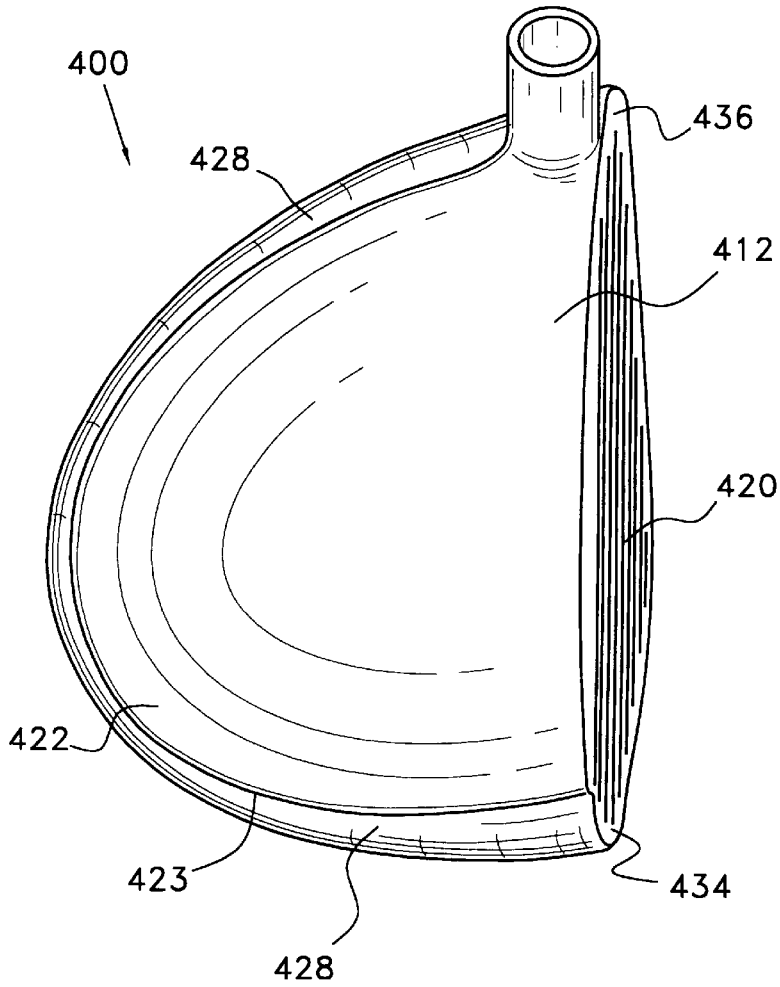
FIG. 9 is a top plan view of FIG. 7.
Figure 10:
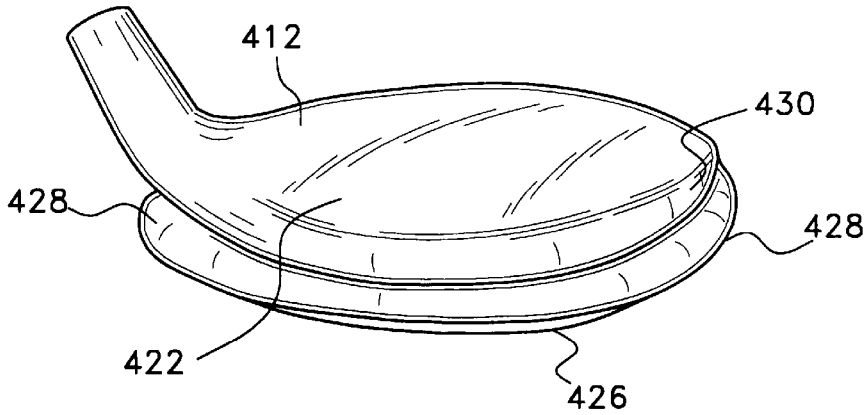
FIG. 10 is a rear elevational view of FIG. 7.
Figure 11:
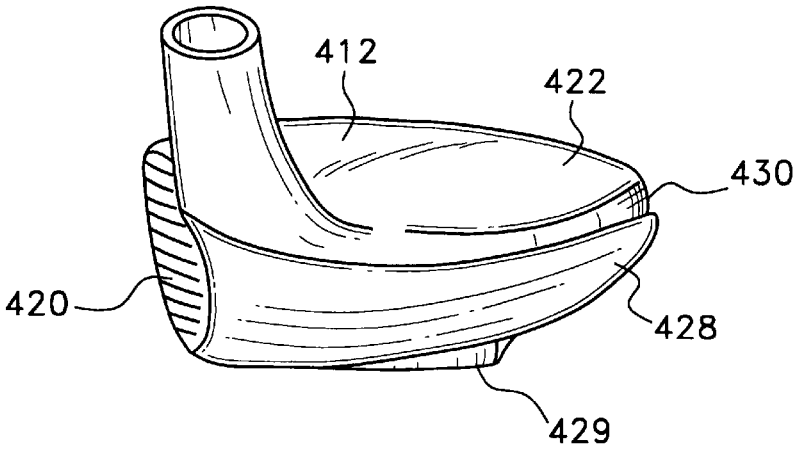
FIG. 11 is an end elevational view of FIG. 7.
Figure 12:
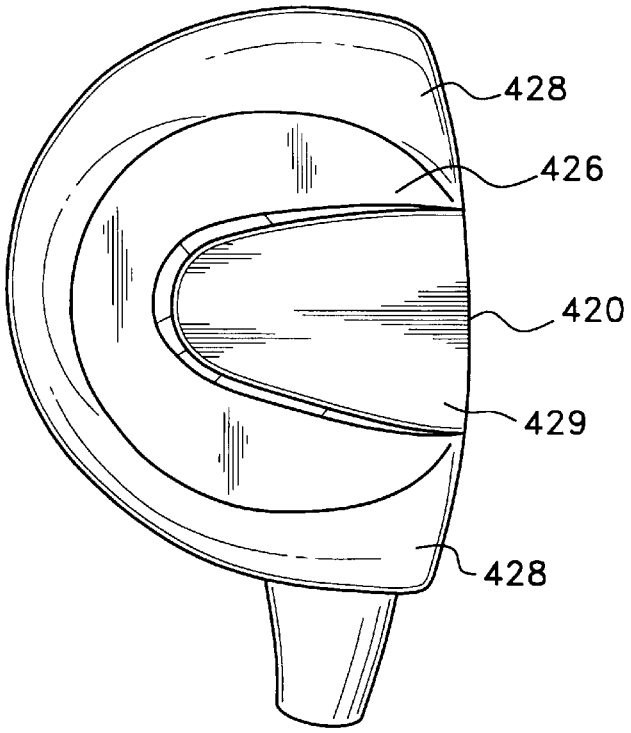
FIG. 12 is a bottom view of FIG. 7.

FIG. 6 illustrates a third embodiment of a golf club head 300 of the present invention wherein a reinforcing and stabilizing member 328 with a non-coincident bottom surface 336, is located toward the top surface of side wall 330 adjacent crown surface 322 of the club head 300.

FIGS. 7–12 illustrate a fourth embodiment of a club head 400 of the present invention. In this embodiment, a reinforcing and stabilizing member 428 is generally elliptical in shape. The member 428 includes front surfaces 434 and 436 laterally coincident with the ball striking face 420 of the club head 400 and wraps around the club head body 412 between the toe 418 and heel 416. As seen in plan in FIG. 9, the member 428 extends outwardly beyond the peripheral edge 423 of the crown 422 and in FIG. 12, the member 428 extends outwardly beyond the bottom 426 of the club head 400. The club head 400 includes a sole skimmer 429 on the bottom 426.

Figure 13:
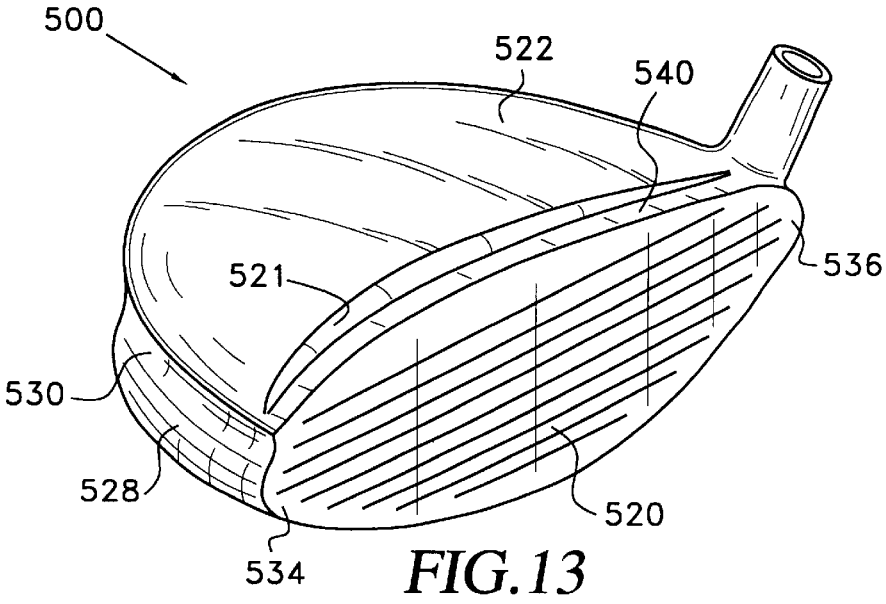
FIG. 13 is a top perspective view of a fifth embodiment of the present invention.
Figure 14:
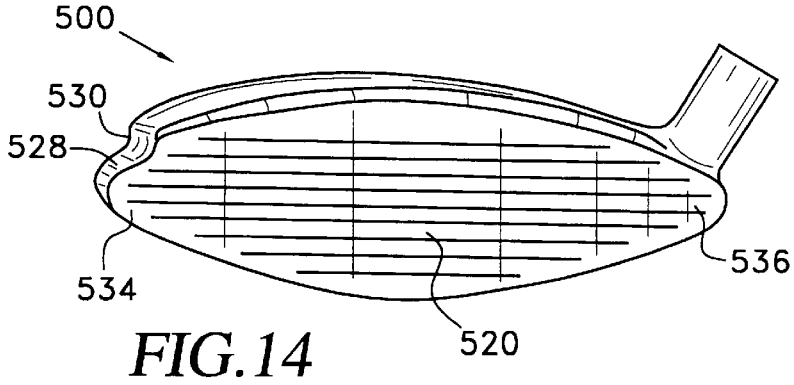
FIG. 14 is a front elevational view of FIG. 13.

FIGS. 13 and 14 illustrate a fifth embodiment of a club head 500 of the present invention. A reinforcing and stabilizing member 528 includes front surfaces 534 and 536 laterally coincident with the ball striking face 520 of the club head 500. A ledge 540 is set back from the ball striking face 520 and sloped front surface 521 of crown 522 favorably alters air flow by more effectively accelerating it across the surface of the crown 522 of the club head 500.

Figure 15:
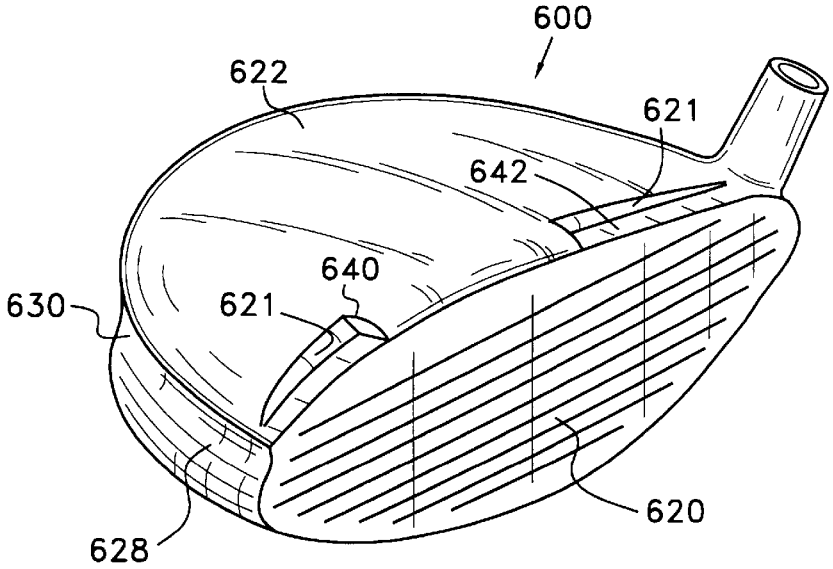
FIG. 15 is a top perspective view of a sixth embodiment of the present invention.

FIG. 15 illustrates a sixth embodiment of a club head 600 of the present invention including a reinforcing and stabilizing member 628 and a pair of ledges 640 and 642 which are set back from the ball striking face 620 with sloped front surfaces 621 of crown 622.

Figure 16:
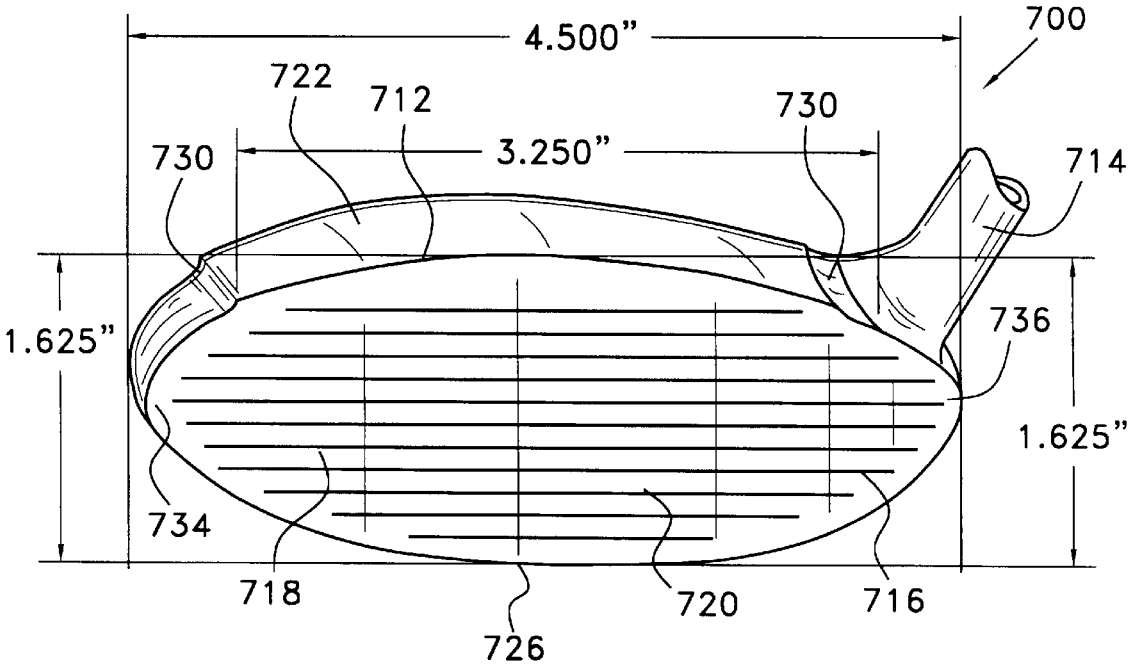
FIG. 16 is a front elevation view of a seventh embodiment of the present invention.

FIGS. 16 shows an embodiment of a golf club head 700 in accordance with the present invention including a club head body 712, hosel 714, heel 716, toe 718, ball striking face 720, upper surface 722, and bottom sole 726. In this embodiment, reinforcing and stabilizing members 734 and 736, having an aerodynamic shape, are located coincident with the ball striking face 720 of the club head 700 and wrap rearwardly as with the above-described embodiments. The reinforcing and stabilizing members 734 and 736 extend outwardly beyond the side wall surfaces 730 as defined by the lateral extension of the upper crown surface 722. In this embodiment, the upper crown surface 722 is preferably 3.500 inches in length in a heel 716 to toe 718 direction. The overall heel to toe length of the ball striking face 720, including the reinforcing and stabilizing members 734 and 736, is a total of 4.500 inches, with a height of approximately 1.625 inches, thereby extending the lateral dimensions of the club face approximately one half inch, 0.500 inches, at both the heel 716 and toe 718 of the club head 700.

Figure 17:
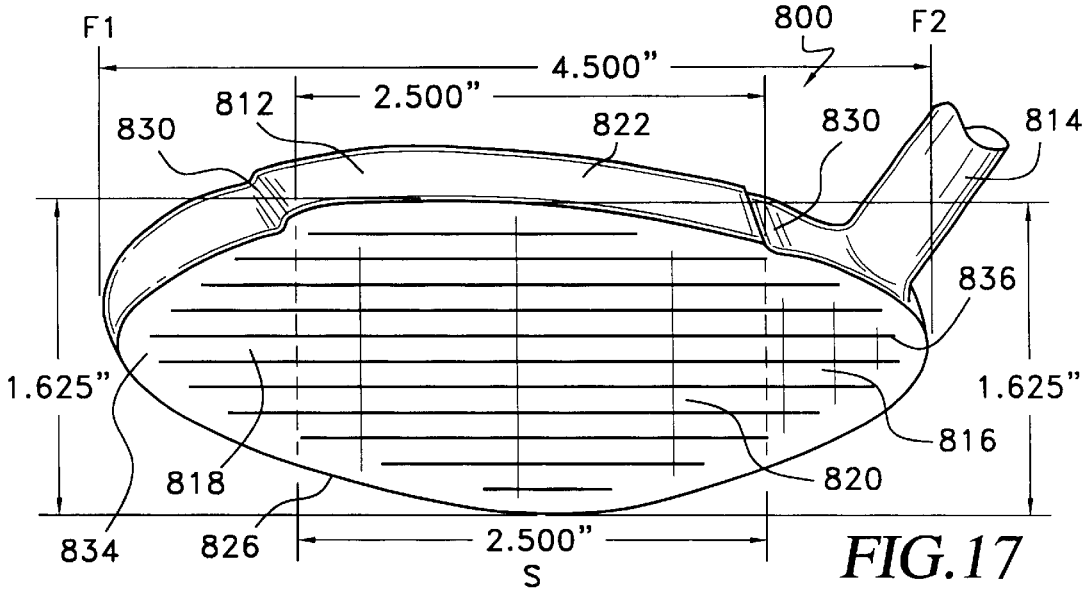
FIG. 17 is a front elevation view of an eight embodiment of the present invention.

FIG. 17 shows an embodiment of a golf club head 800 in accordance with the present invention including a club head body 812, hosel 814, heel 816, toe 818, ball striking face 820, upper crown surface 822, and bottom sole 826. In this embodiment, reinforcing and stabilizing members 834 and 836, having an aerodynamic shape, are located coincident with the ball striking face 820 of the club head 800 and wrap rearwardly as with the above-described embodiments. The reinforcing and stabilizing members 834 and 836 extend outwardly beyond the side wall surfaces 830 as defined by the lateral extension of the upper crown surface 822. In this embodiment, the upper crown surface 822 is shorter than the previous embodiment, preferably 2.500 inches in length in a heel 816 to toe 818 direction. The overall heel to toe length of the ball striking face 820, including the reinforcing and stabilizing members 834 and 836, is a total of 4.500 inches, with a height of approximately 1.625 inches, thereby extending the lateral dimensions of the club face approximately one inch, 1.00 inch, at both the heel 816 and toe 818 of the club head 800.

Figure 18:
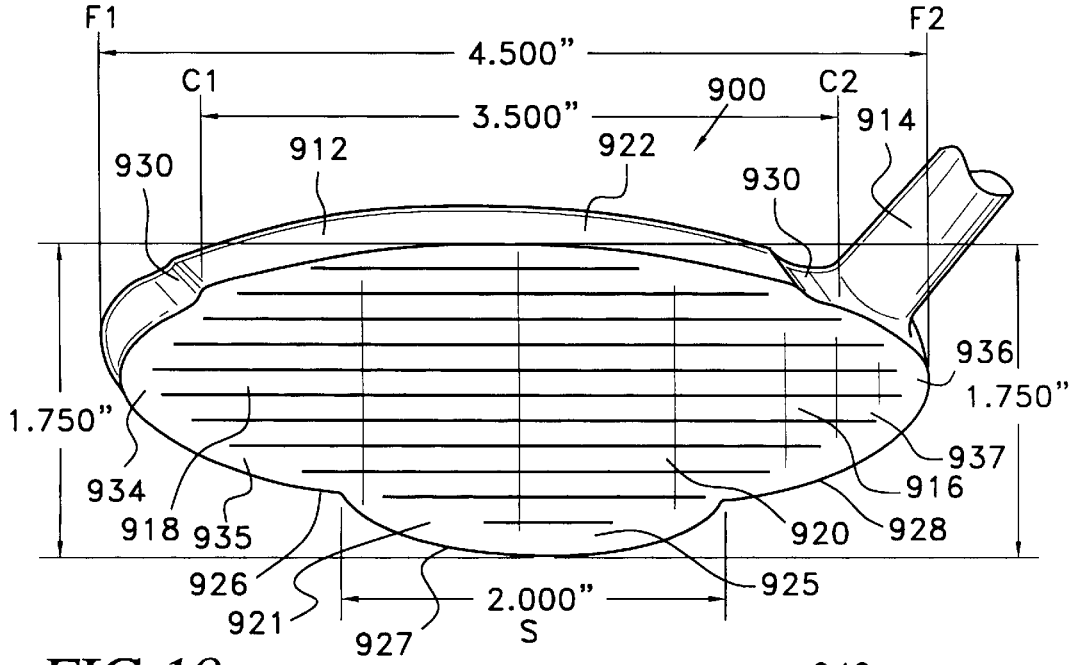
FIG. 18 is a front elevation view of a ninth embodiment of a golf club head in accordance with the present invention.
Figure 19:
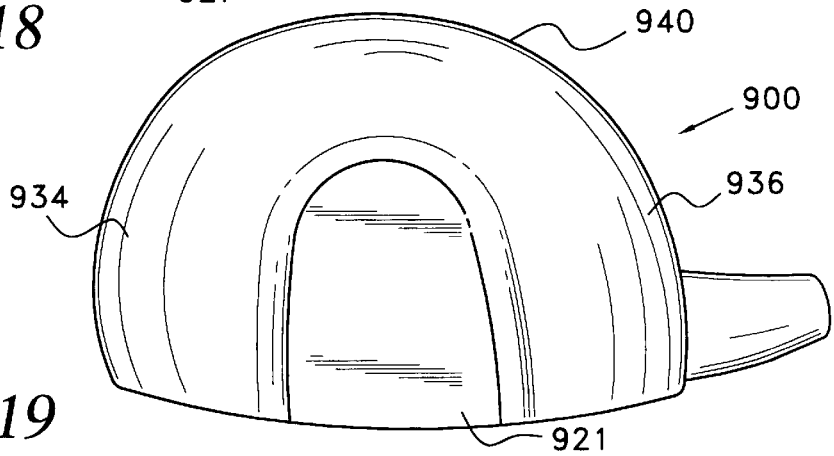
FIG. 19 is a bottom view of the golf club head of FIG. 18.

FIGS. 18 and 19 show an embodiment of a golf club head 900 in accordance with the present invention including a club head body 912, hosel 914, heel 916, toe 918, ball striking face 920, and upper crown surface 922. Reinforcing and stabilizing members 934 and 936, have an aerodynamic shape which wraps rearwardly as with the above-described embodiments, and are located laterally and outwardly from the heel and toe sections 916 and 918. Reinforcing and stabilizing members 934 and 936 include front faces 935 and 937 which are coincident with the ball striking face 920 of the club head 900 and bottom aerodynamic surfaces 926 and 928. The reinforcing and stabilizing members 934 and 936 extend outwardly beyond the side wall surfaces 930 as defined by the lateral extension of the upper crown surface 922. In this embodiment, ball striking face 920 features a main, centrally located, upper section including the expanded areas of the club face at 934 and 936, and further includes a reinforcing and stabilizing member 921 having another bottom surface 927, located below bottom surfaces 926 and 928, and having a front face 925 which is coincident with the ball striking face 920 and extends rearwardly partway to the rear edge 940 of the club head 900. This provides a distinctive second lower section expanding the club face hitting area at the exact bottom of the ball striking face 920. The reinforcing and stabilizing member 921 extends rearwardly on the bottom surface 926 and supports the club head 900 in a slightly raised position above the ground whereby the club face 920 is in an optimum position to make the most solid ball contact with a golf ball, particularly when the ball is lying in heavy grass. The upper crown surface 922 is preferably 3.500 inches in length in a heel 916 to toe 918 direction. The overall heel to toe length of the ball striking face 920, including the reinforcing and stabilizing members 934 and 936, is approximately 4.500 inches, with a height of approximately 1.750 inches, thereby extending the lateral dimensions of the club face approximately one half inch, 0.500 inches, at both the heel 916 and toe 918 of the club head 900.

Figure 20:
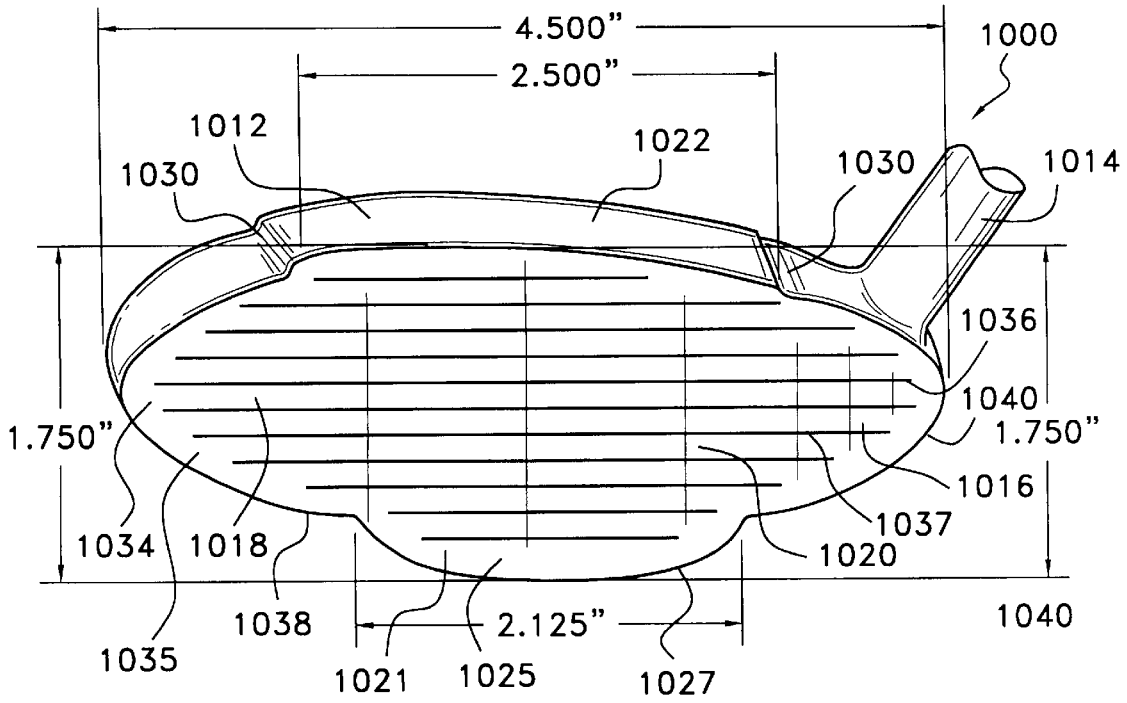
FIG. 20 is a front elevation view of a tenth embodiment of a golf club head in accordance with the present invention.

FIG. 20 shows an embodiment of a golf club head 1000 in accordance with the present invention including a club head body 1012, hosel 1014, heel section 1016, toe section 1018, ball striking face 1020, and an upper crown surface 1022. In this embodiment, reinforcing and stabilizing members 1034 and 1036, have an aerodynamic shape and which wrap rearwardly as with the above-described embodiments, and are located laterally and outwardly from the heel and toe sections 1016 and 1018. Reinforcing and stabilizing members 1034 and 1036 include front faces 1035 and 1037 which are coincident with the ball striking face 1020 of the club head 1000 and bottom surfaces 1038 and 1040. The reinforcing and stabilizing members 1034 and 1036 are further defined as extending outwardly beyond the side wall surfaces 1030 at the outer edges of the upper crown surface 1022. In this embodiment, ball striking face 1020 includes a lower reinforcing and stabilizing member 1021 having another bottom surface 1027 which includes a front face 1025 coincident with the ball striking face 1020 thereby providing a greater club face hitting area at the lowest bottom portion of the ball striking face 1020. The reinforcing and stabilizing member 1021 extends rearwardly between bottom surfaces 1038 and 1040 and supports the club head 1000 in a slightly raised position above the ground whereby the club face 1020 is in an optimum position to strike a golf ball, particularly when the ball is lying in heavy grass. The bottom 1027 of the reinforcing and stabilizing member 1021 is non-coincidental with and spaced from the bottom surfaces 1038 and 1040 of reinforcing and stabilizing members 1034 and 1036 respectively. The upper crown surface 1022 is preferably 2.500 inches in length in a heel section 1016 to toe section 1018 direction thereby extending the lateral dimensions of the club face approximately one inch, 1.00 inch, at both the heel section 1016 and toe section 1018 of the club head 1000.

Figure 21:
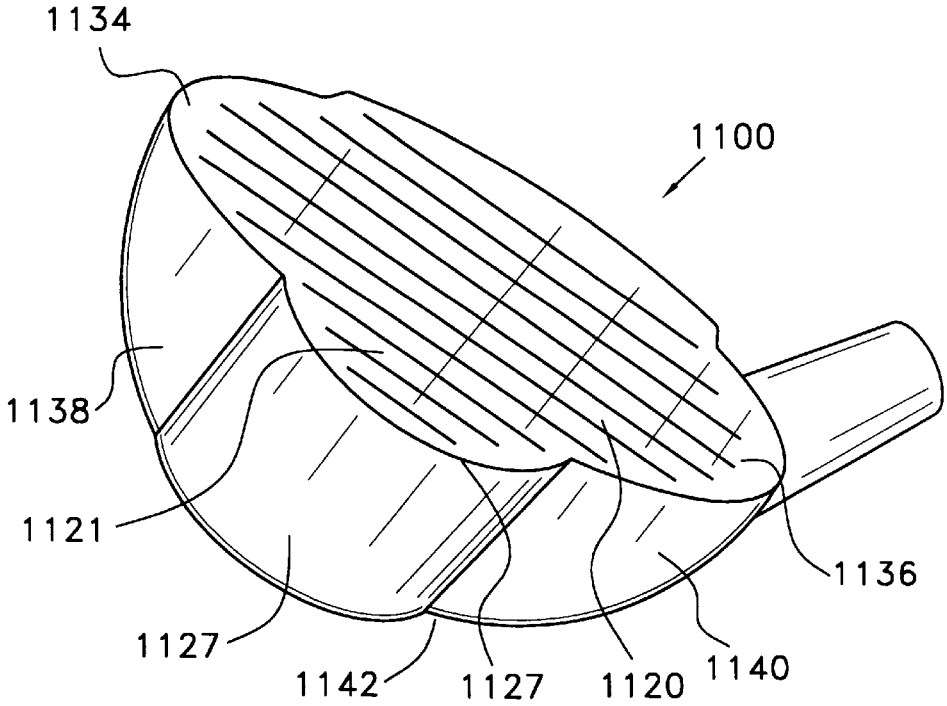
FIG. 21 is a bottom view of a eleventh embodiment of a golf club head in accordance with the present invention.

FIG. 21 shows another embodiment of a golf club head 1100 in accordance with the present invention having reinforcing and stabilizing members 1134 and 1136 with bottom surfaces 1138 and 1140 respectively, and a reinforcing and stabilizing member 1121 with a bottom surface 1127 which is coincident with the front face 1120 and which extends to the rear surface 1142 of the club head 1100.

Figure 22:
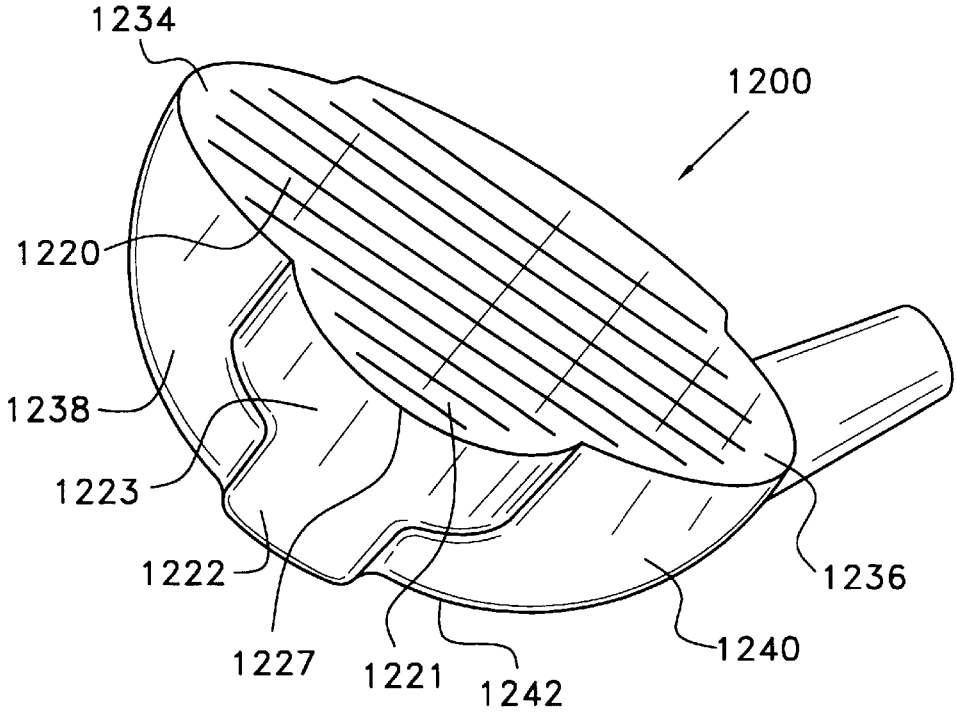
FIG. 22 is a bottom view of a twelth embodiment of a golf club head in accordance with the present invention.

FIG. 22 shows another embodiment of a golf club head 1200 in accordance with the present invention having reinforcing and stabilizing members 1234 and 1236 with bottom surfaces 1238 and 1240 respectively, and a reinforcing and stabilizing member 1221 with a bottom surface 1227 which is coincident with the front face 1220 and extends to the rear surface 1242 of the club head 1200, the rearward portion 1222 of member 1221 being narrower than the front portion 1223 at the front face 1220.

Figure 23:
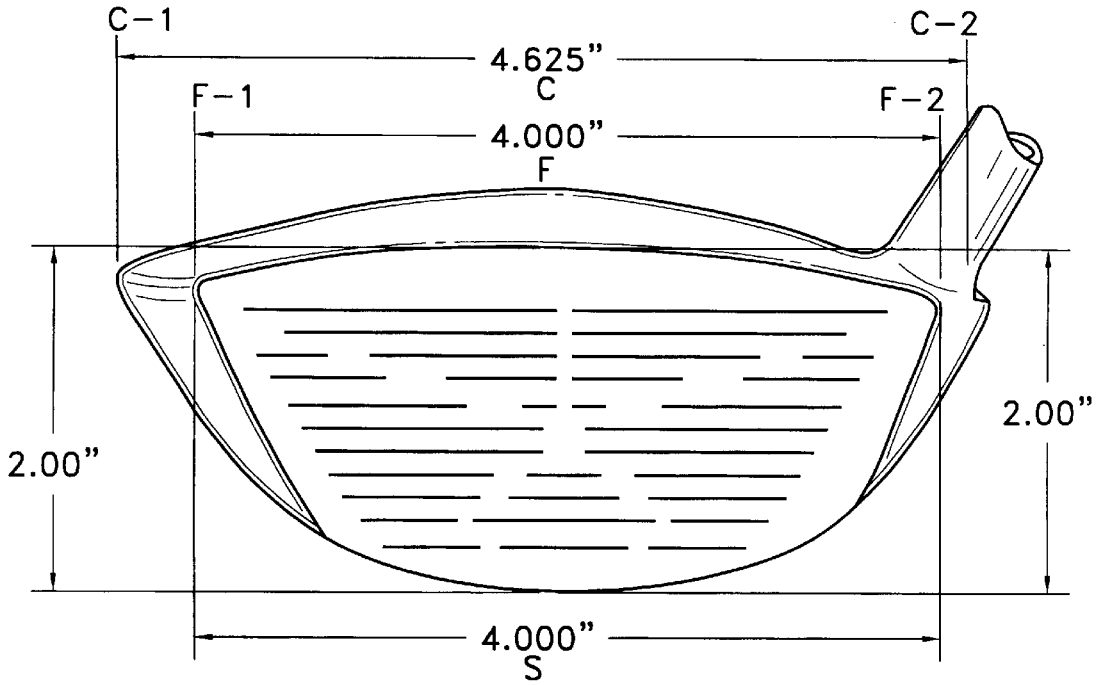
FIG.23 (PRIOR ART)
FIG. 23 is a front elevation view of a prior art golf club.

FIG. 23 shows a typical prior art club head C having a ball striking face F with an inverted trapezoidal shape whereby the hitting area on the face is reduced toward the bottom of the face F as the edges of the face F extend downwardly and inwardly from the bottom of the striking face F.

Figure 24:
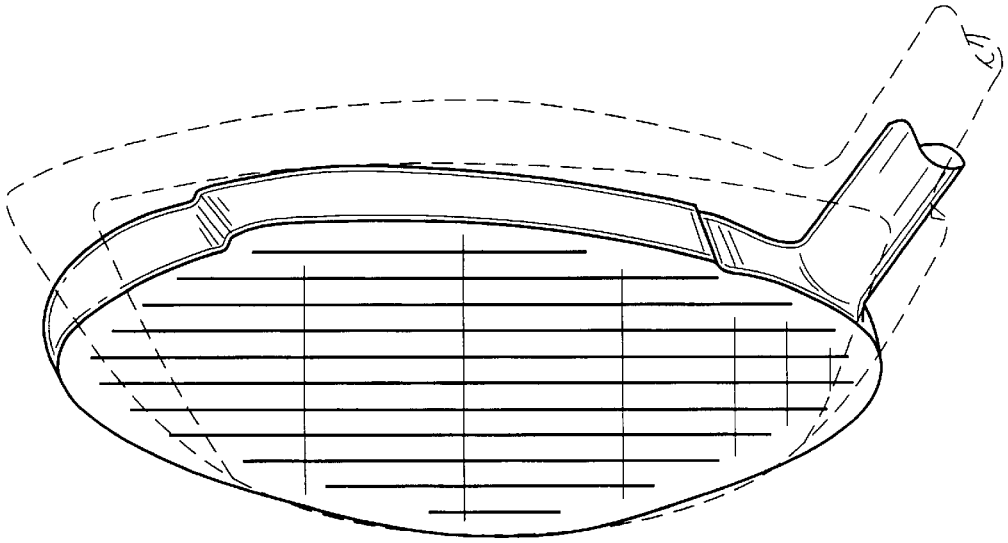
FIG. 24 is a phantom view of the FIG. 16 embodiment of the present invention superimposed on the prior art golf club of FIG. 23.

FIG. 24 shows a view of an embodiment of a golf club head in accordance with the present invention compared to a prior art club head, shown in phantom, of the type shown in FIG. 21. It can be seen the club head of the present invention provides considerable more hitting surface at the heel and toe portions of the club face.

While various preferred embodiments have been shown and described, it will be understood that there is no intent to limit the invention by such disclosure, but rather, is intended to cover all modifications and alternate constructions falling within the spirit and scope of the invention as defined in the following claims.

What is claimed is:

1. A wood type golf club head including a club head body having a shell with a toe, heel, top crown surface, bottom sole, side surfaces, rear surface and ball striking face with a bulge and roll surface configuration, wherein the improvement comprises:

stabilizing and reinforcing means on said side surfaces for expanding perimeter weighting and providing improved and more effective low profile aerodynamics to said club head;

said means including at least one raised, elongated, aerodynamically shaped member extending outwardly from said side surfaces and rear surface, said member having a first front face at said toe section and a second front face at said heel section of club face, said first and second front faces being coincident with and expanding said ball striking face;

said aerodynamically shaped member extending around and beyond the side surfaces, to form the outermost periphery of said club head; and said member being located on said side surfaces approximately midway between said top crown surface and said bottom sole.

2. The club head of claim 1 further including a ledge at an interface of said ball striking face and said top crown surface; said ledge being set back from said ball striking face and providing improved aerodynamic means more effectively altering air flow across said ball striking face and said top surface.

3. The club head of claim 1 further including a first ledge located at said heel area and a second separated ledge at said toe area at an interface between said ball striking face and said top crown surface; said ledges being separated and set back from the end portions of said ball striking face and providing different and more effective aerodynamic means altering air flow across said ball striking face and said top surface.

4. The golf club head of claim 1 wherein said aerodynamically shaped member divides said side surfaces to form an upper side surface adjacent said top crown surface and a lower side surface adjacent said bottom sole.

5. The club head of claim 1 wherein said reinforcing and stabilizing member is integrally formed with said shell and has a cross-sectional thickness greater than the thickness of said shell.

* * * * *